US006659187B1

(12) United States Patent
Crabtree et al.

(10) Patent No.: US 6,659,187 B1
(45) Date of Patent: Dec. 9, 2003

(54) SELF METERING FOAM PROPORTIONING SYSTEM

(75) Inventors: Dennis W. Crabtree, Beaumont, TX (US); Duane J. Brinkerhoff, Orange, TX (US); Eric LaVergne, Groves, TX (US)

(73) Assignee: Williams Fire & Hazard Control, Inc, Vidor, TX (US)

( * ) Notice: Subject to any disclaimer, the term of this patent is extended or adjusted under 35 U.S.C. 154(b) by 0 days.

(21) Appl. No.: 09/648,351

(22) Filed: Aug. 25, 2000

Related U.S. Application Data

(63) Continuation-in-part of application No. 09/593,360, filed on Jun. 14, 2000, which is a continuation-in-part of application No. 09/284,561, filed as application No. PCT/US98/20061 on Sep. 25, 1998, and a continuation-in-part of application No. 09/096,798, filed on Jun. 12, 1998, now Pat. No. 6,138,767.

(60) Provisional application No. 60/080,846, filed on Apr. 6, 1998, and provisional application No. 60/049,537, filed on Jun. 13, 1997.

(51) Int. Cl.[7] ..... A62C 2/00

(52) U.S. Cl. ..... 169/44; 169/14; 169/15; 239/318

(58) Field of Search ..... 169/14, 15, 44; 239/310, 318; 137/488, 895

(56) References Cited

U.S. PATENT DOCUMENTS

| | | | | | |
|---|---|---|---|---|---|
| 1,591,401 | A | * | 7/1926 | Palmer | 169/15 |
| 3,047,003 | A | * | 7/1962 | Gurney | 137/100 |
| 3,714,988 | A | * | 2/1973 | Livingston | 169/13 |
| 3,739,794 | A | * | 6/1973 | Lindgren | 137/1 |
| 3,934,604 | A | * | 1/1976 | Sanderson et al. | 137/114 |
| 4,224,956 | A | * | 9/1980 | Klein | 137/114 |
| 5,582,776 | A | * | 12/1996 | Crawley et al. | 169/15 |
| 5,909,775 | A | * | 6/1999 | Grindley | 169/14 |
| 5,979,564 | A | * | 11/1999 | Crabtree | 169/15 |
| 5,996,700 | A | * | 12/1999 | Sulmone | 169/15 |
| 6,074,176 | A | * | 6/2000 | Conkin et al. | 137/100 |

* cited by examiner

*Primary Examiner*—Steven J. Ganey
(74) *Attorney, Agent, or Firm*—Sue Z Shaper, P.C.

(57) ABSTRACT

A fire fighting fluid proportioning system and method including a fire fighting fluid conduit in fluid communication with a fire fighting fluid regulating valve and a venturi, the venturi in fluid communication with a valve source of fire fighting foam concentrate, and having a pilot valve connected directly or indirectly to the regulating valve and the concentrate source valve and adapted to adjust, directly or indirectly, the regulating valve and the source valve in response to a sensed indicia of fire fighting fluid pressure in the conduit.

16 Claims, 10 Drawing Sheets

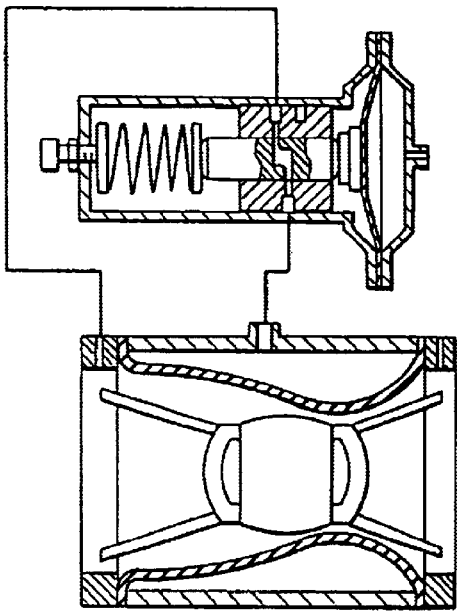

FIG. 2A (PRIOR ART)

DELIVERY PRESSURE EXCEEDS THE PRESET POINT. THE PILOT ALLOWS INLET PRESSURE TO FLOW INTO THE CONTROL SPACE INBAL VALVE NARROWS THE WATER PASSAGE, DELIVERY PRESSURE IS REDUCED TO THE PRESET POINT.

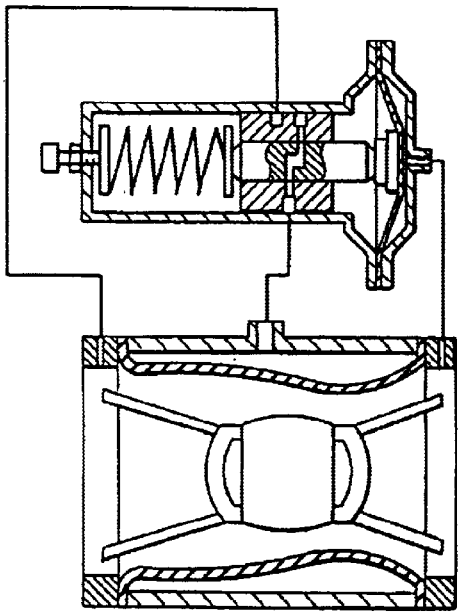

FIG. 2B (PRIOR ART)

DELIVERY PRESSURE DROPS BELOW THE PRESET POINT RELEASES THE CONTROL SPACE TO ATMOSPHERE. INBAL VALVE OPENS FURTHER AND DELIVERY PRESSURE INCREASES TO PRESET POINT.

AS SOON AS DELIVERY PRESSURE IS PRECISELY AS PRESET POINT, CONTROL SPACE IS "LOCKED". NO FLOW IS PERMITTED NOW THROUGH PILOTING SSYSTEM.

SELF METERING FOAM PROPORTIONING SYSTEM

This application is a continuation-in-part of U.S. Ser. No. 09/096,798, filed Jun. 12, 1998 now U.S. Pat. No. 6,138,767, which is a continuation-in-part of provisional application U.S. Ser. No. 60/049,537, filed Jun. 13, 1997. This application is also a continuation-in-part of U.S. Ser. No. 09/593,360 filed Jun. 14, 2000 which is a continuation in part of U.S. Ser. No. 09/284,561, filed Apr. 15, 1999, which stems from PCT application U.S. Ser. No. 98/20061, filed Sep. 25, 1998, which relates back to provisional application U.S. Serial No. 60/080,846, filed Apr. 6, 1998.

FIELD OF THE INVENTION

This invention relates to fluid additive supply systems for fire fighting equipment, and in particular, to systems for adding foam concentrate into a water stream used for fire fighting operations.

BACKGROUND OF THE INVENTION

This application herein incorporates by reference in its entirety applications U.S. Ser. No. 09/096,798 and U.S. Ser. No. 09/284,561.

Fire fighting equipment frequently requires a mechanism that can supply an additive, such as a foam concentrate, into the equipment's water stream. An additive, such as foam concentrate, is usually designed to be metered into a water stream at a constant percent, such as 1%, 3%, 6% of foam concentrate to water. A foam concentrate proportioning system is a system that meters, or attempts to meter, foam concentrate at a percent into a water stream. Frequently variations in flow rate of the water stream require manual adjustment of the metering system.

The instant invention relates to systems that supply additives into water streams using eduction, or a venturi device. The venturi output is connected to a conduit for fire fighting fluid. The venturi inlet can be powered by fluid from that conduit or by an independent source of fluid, such as from a separate water pump. The venturi uses fluid flow to create a pressure drop across an orifice. The pressure drop draws in or helps to drawn in additive, which additive may be at atmospheric pressure or higher pressure.

The instant invention addresses the problem of automatically metering foam concentrate into a flow of fire fighting fluid in a conduit, automatically coordinating the metering with variations in flow of the fire fighting fluid. An object of the invention is for the proportion of concentrate to fire fighting fluid to automatically remain (approximately) constant, at a preselected level, notwithstanding variations in fluid flow. A flow regulating valve for regulating flow (and/or pressure, since the two are related) of the fire fighting fluid in the conduit is utilized, which helps insure proper functioning of the venturi, together with a pilot valve to adjust the regulating valve in concert with a valve metering foam concentrate from a foam concentrate source.

The instant invention in particular can be used with a "Through the Pump Foam System," incorporated by reference to U.S. patent application Ser. No. 09/096,798 above. The instant invention represents an improvement to a Through the Pump System in that the instant invention adjusts a fire fighting fluid regulating valve and a foam concentrate source valve in response to sensed indicia of fire fighting fluid pressure (or flow) in the conduit. Said otherwise, the two valves adjust in tandem.

The Constant Pressure Drop Foam Proportioner of U.S. Ser. No. 09/593,360, also incorporated by reference herein, discloses a foam proportioning device used in association with a piston within a fluid conduit, which piston can maintain fire fighting fluid pressure at a preselected level. A pilot valve, shown both exterior to the conduit and designed within the piston in that application, serves to maintain a constant preselected pressure. As the piston varies in the fire fighting fluid conduit, in response to the pilot valve, the flow rate of the fire fighting fluid varies. As the piston varies an extension of the piston varies a foam concentrate metering orifice, supplying or feeding a venturi. Hence the piston varies fire fighting fluid flow and foam concentrate flow, in tandem.

The instant invention combines portions of a Constant Pressure Drop Foam Proportioner into a device usable in a Through The Pump Foam Systems. The instant invention improves upon prior Through The Pump Foam Systems by the fact that an additive metering valve is automatic, as in the Constant Pressure Drop Foam Proportioner. Other variations in design of the instant preferred embodiment shown, but not necessary, are the design and operation of the unit pilot valve and the design of the flow regulating valve.

SUMMARY OF THE INVENTION

The invention comprises a fire fighting fluid foam proportioning system including a fire fighting fluid conduit in fluid communication with a fire fighting fluid regulating valve and a venturi. The venturi is in fluid communication with a motive source of fluid and a valved source of fire fighting foam concentrate. A pilot valve is connected to the regulating valve and at least indirectly to the concentrate source valve. The pilot valve is adapted to adjust the regulating valve and at least indirectly the concentrate source valve in response to a sensed indicia of fire fighting fluid pressure in the conduit. The invention also includes a method for proportioning fire fighting foam concentrate comprising educting fire fighting foam concentrate into a fire fighting fluid conduit. The method includes regulating fire fighting fluid flow in the conduit in accordance with a sensed indica of fire fighting fluid pressure in the conduit and automatically metering foam concentrate to the eductor in concert with regulated fire fighting fluid flow in the conduit.

A better understanding of the present invention can be obtained from the detailed description of exemplary embodiments set forth below, to be considered in conjunction with the attached drawings in which:

BRIEF DESCRIPTION OF THE DRAWINGS

FIGS. 2A, 2B and 2C illustrate a representative Inbal prior art pressure reducing valve.

DETAILED DESCRIPTION OF PREFERRED EMBODIMENTS

Figure 1A:
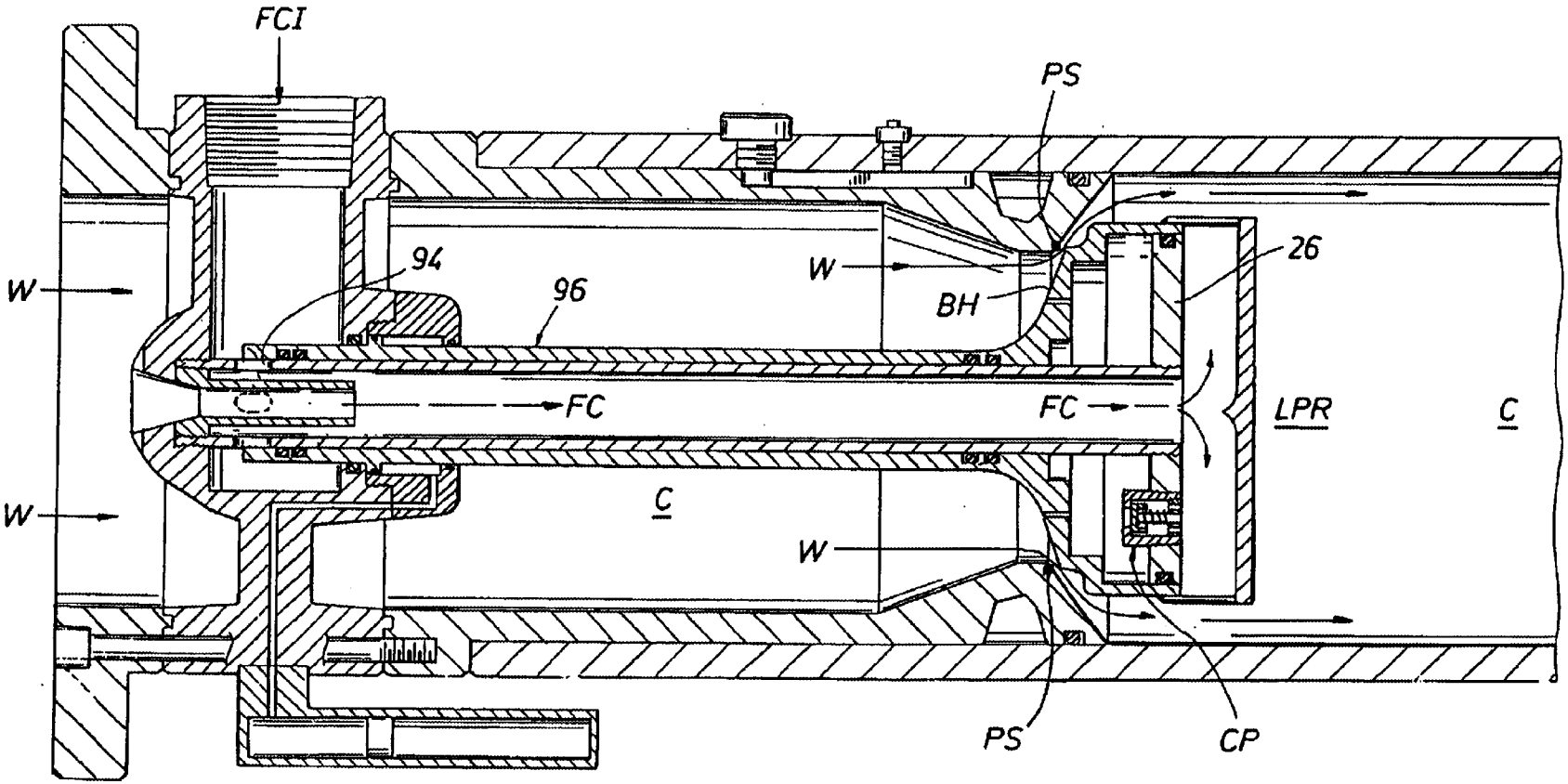
FIGS. 1A and 1B illustrate, from the Constant Pressure Drop Foam Proportion application, a self metering flow control mechanism, the pilot valve connection not illustrated in FIG. 1B, although illustrated in other figures in that application.
Figure 1B:
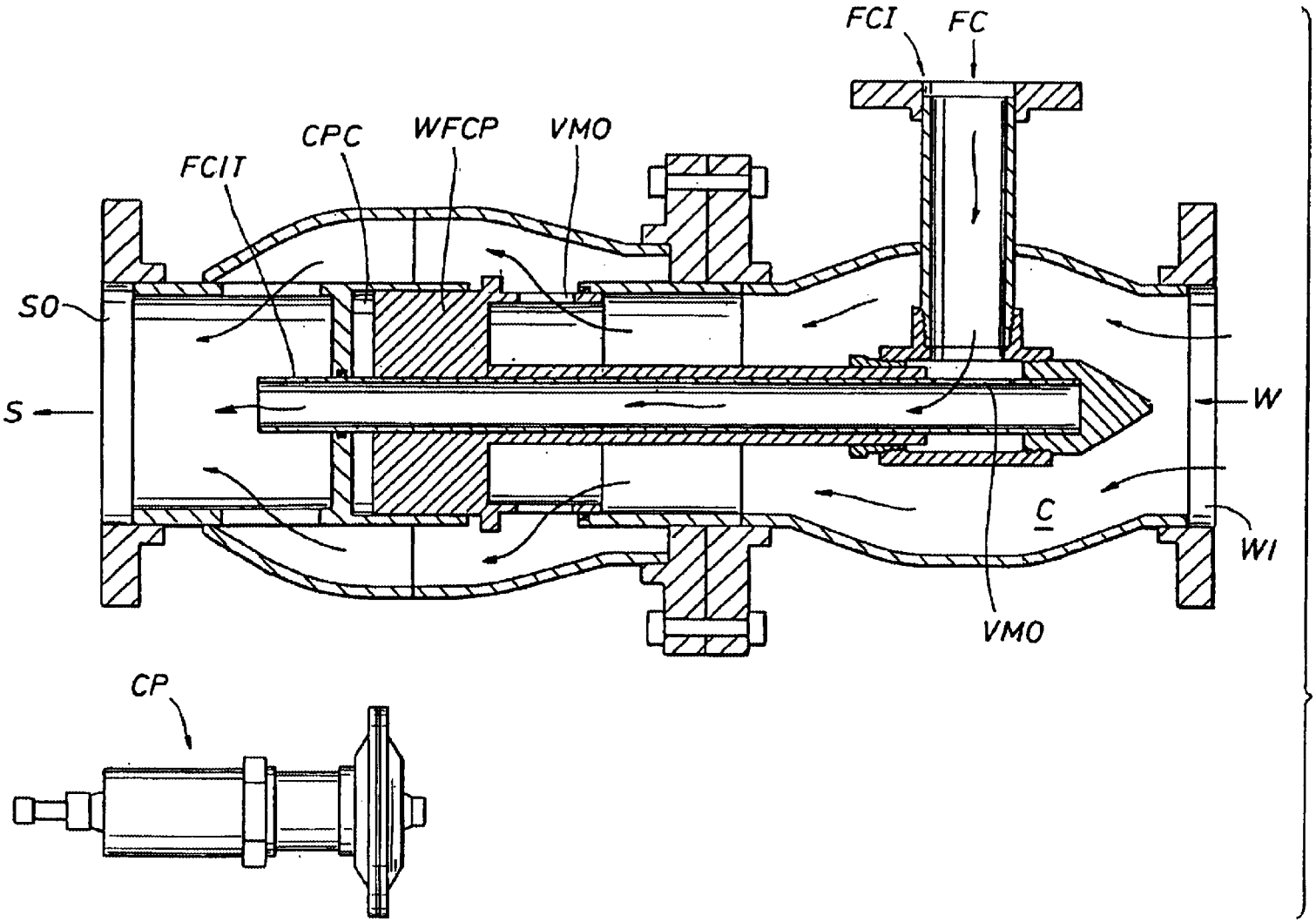

FIGS. 1A and 1B illustrate embodiments of a Constant Pressure Drop Foam Proportioner. Pilot relief valve CP installed on fixed piston 26 and within the bafflehead chamber adjusts fluid pressure between fixed piston 26 and bafflehead BH such that bafflehead BH creates a gap between bafflehead BH and neck element PS of the nozzle body. Flow through the gap is maintained by the pilot valve such that the pressure at the gap is approximately a preset pressure. Foam metering orifice 94 is adjusted in size by virtue of the movement of metering tube 96 associated with floating bafflehead BH. In such manner a foam concentrate supplied through foam inlet FCI is metered into foam metering tube 96 and discharged into the flowing fluid stream downstream of the gap at a metered rate approximately proportional to the flow rate of the fluid W through the conduit. In FIG. 1B the foam metering orifices are identified as elements VMO. The piston is element WFCP. The pilot valve CP is attached exterior to the fire fighting fluid conduit C, as opposed to being installed within the bafflehead and piston as in FIG. 1A.

Figure 2C:
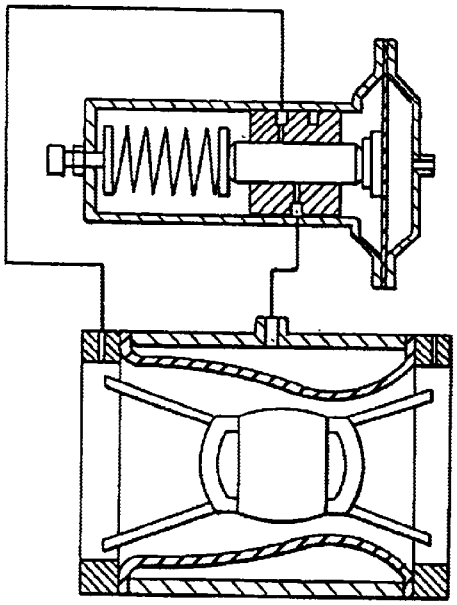
FIG. 2C (PRIOR ART)

FIGS. 2A, 2B and 2C illustrate a commercially available pressure reducing valve and concomitant pilot valve. The manufacturer is Inbal. The page comes from an Inbal catalog. As illustrated in FIG. 2A when delivery pressure exceeds a preset point the pilot allows inlet pressure to flow into the Inbal "control space." As the Inbal valve narrows the water pressure delivery pressure is reduced to the preset point. When delivery pressure drops below a preset point, as illustrated in FIG. 2B, the pilot releases the control space to atmosphere. The Inbal valve opens further and delivery pressure increases to the preset point. As illustrated in FIG. 2C, when delivery pressure is at the preset point the control is locked.

Figure 3:
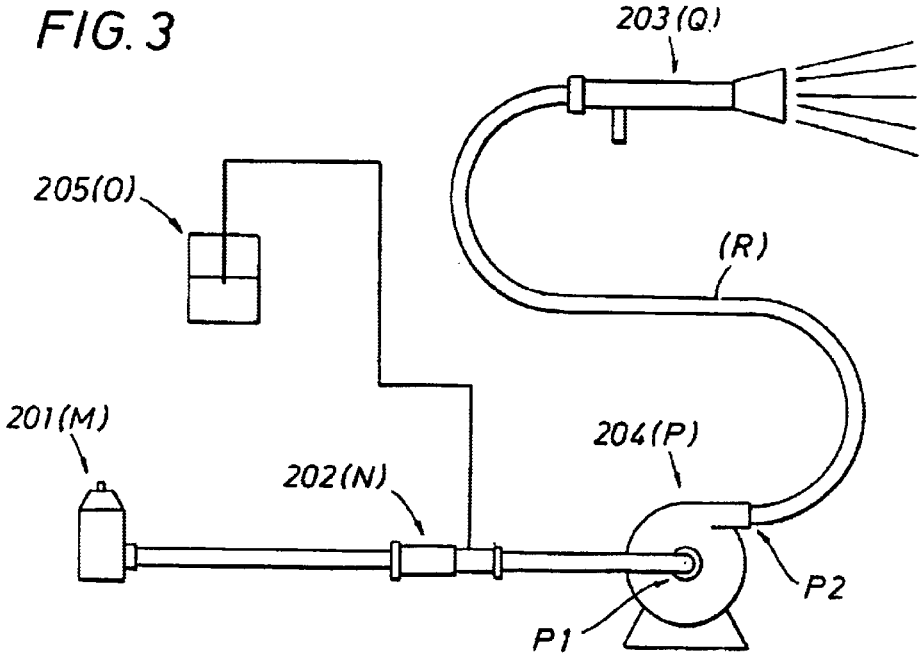
FIG. 3 illustrates a "through the pump" foam proportioning system.

FIG. 3 illustrates a through the pump foam system, in general. A pressurized water supply source 201 supplies water to a through the pump foam system unit 202. The through the pump foam system unit is connected through water pump 204 to distribution device 203. An additive source 205 is shown connected to the pump foam system unit 202.

Figure 4A:
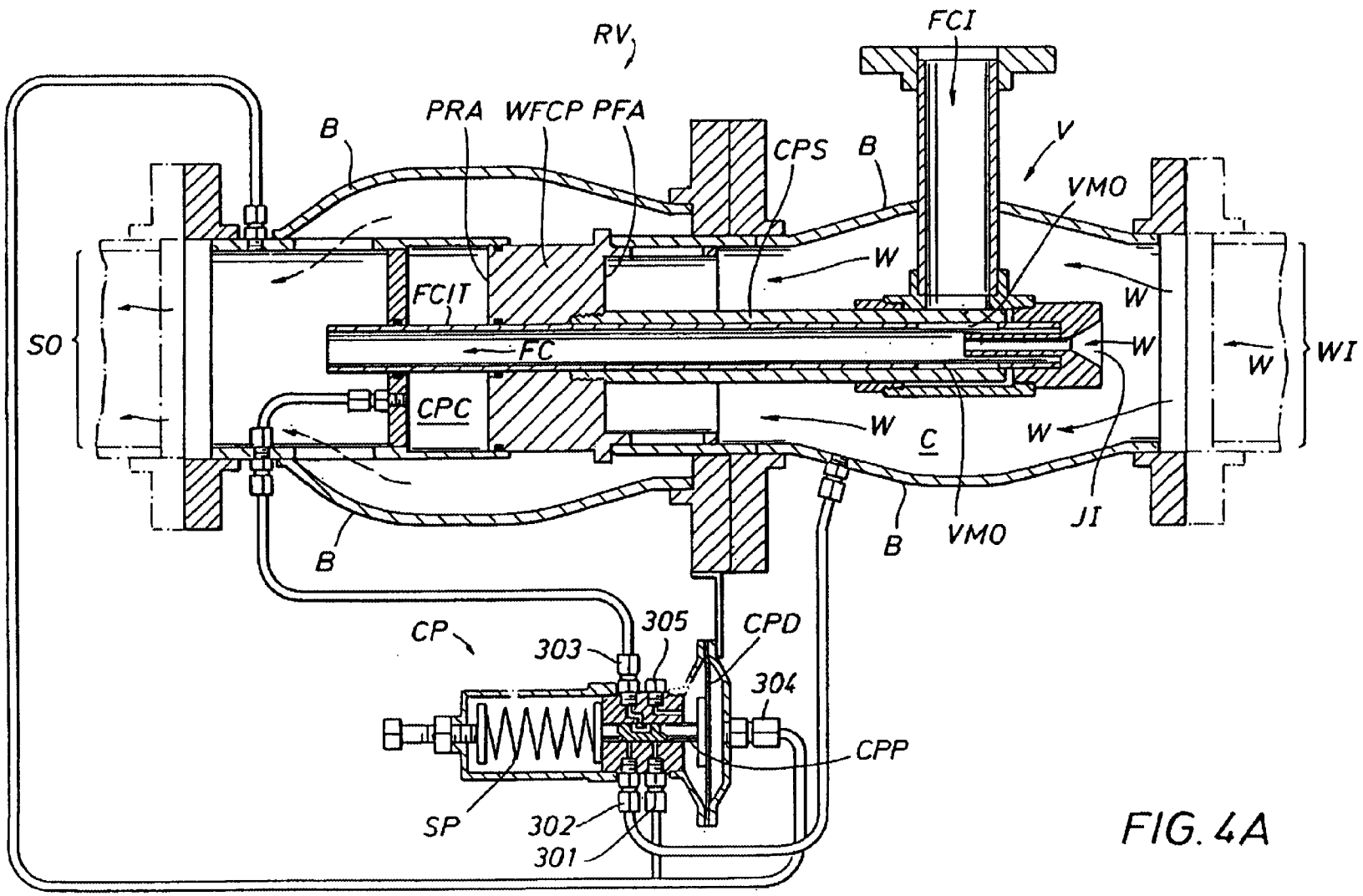
FIGS. 4A and 4B illustrate a preferred embodiment of a self-metering foam proportioning system for use with a fire fighting fluid conduit and fire fighting fluid regulating valve, in accordance with the present invention.

FIG. 4A illustrates a preferred embodiment of a self-metering foam proportioning system of the instant invention, suitable to form a through the pump foam system unit 202. The fire fighting fluid is illustrated as water W, and passes through the regulating valve from right to left in FIG. 4A.

FIG. 4A illustrates a fire fighting fluid proportioning system in accordance with a preferred embodiment of the present invention. The fire fighting fluid is indicated as water W. Water W enters a conduit C defined by proportioner body elements B at entrance WI and exits conduit C at the left in the drawing at exit SO. Fire fighting fluid conduit C in FIG. 4A has a fire fighting fluid regulating valve RV and venturi, contained therein. The regulating valve RV includes control piston WFCP. FIG. 4A shows the control piston in its closed position. Water is not flowing through conduit C in the illustration of FIG. 4A. The dashed lines indicate the path the water would take if control piston WFCP were open.

The venturi in FIG. 4A includes foam concentrate tube FCIT in fluid connection through variable metering orifices VMO with foam concentrate inlet FCI. Water entering conduit C also enters the venturi through jet inlet JI in FIG. 4A. In a known manner the venturi increases the velocity of the entering water and then discharges the water into an expanded chamber proximate the variable metering orifice. The pressure drop associated with the discharge of the water from the small venturi tube into the foam concentrate tube CIT creates a low pressure region drawing in foam concentrate through variable metering orifices VMO into the foam concentrate tube VCIT. The foam concentrate and water moves down foam concentrate tube FCIT and discharges into conduit C. Piston WFCP only opens wide enough such that flow of water downstream past the piston and past the discharge of foam concentrate tube FCIT maintains a sufficiently low pressure such that the foam concentrate will discharge from the foam concentrate tube FCIT into the conduit C. Tube CPS attached to the water flow control piston increases and decreases the effective size of variable metering orifices VMO as the water flow control piston adjusts to the left and to the right. The greater the water flow allowed, the larger the variable metering orifice and the greater the foam concentrate drawn into the foam concentrate tube FCIT. The foam concentrate source may be at ambient or above ambient pressure.

Pilot valve CP governs the movement of water flow control piston WFCP. In the preferred embodiment of FIG. 4A pilot valve CP is installed exterior to conduit C. Such location facilitates access to and repair of pilot valve CP, and permits using a large and more accurate pilot valve.

Figure 4B:
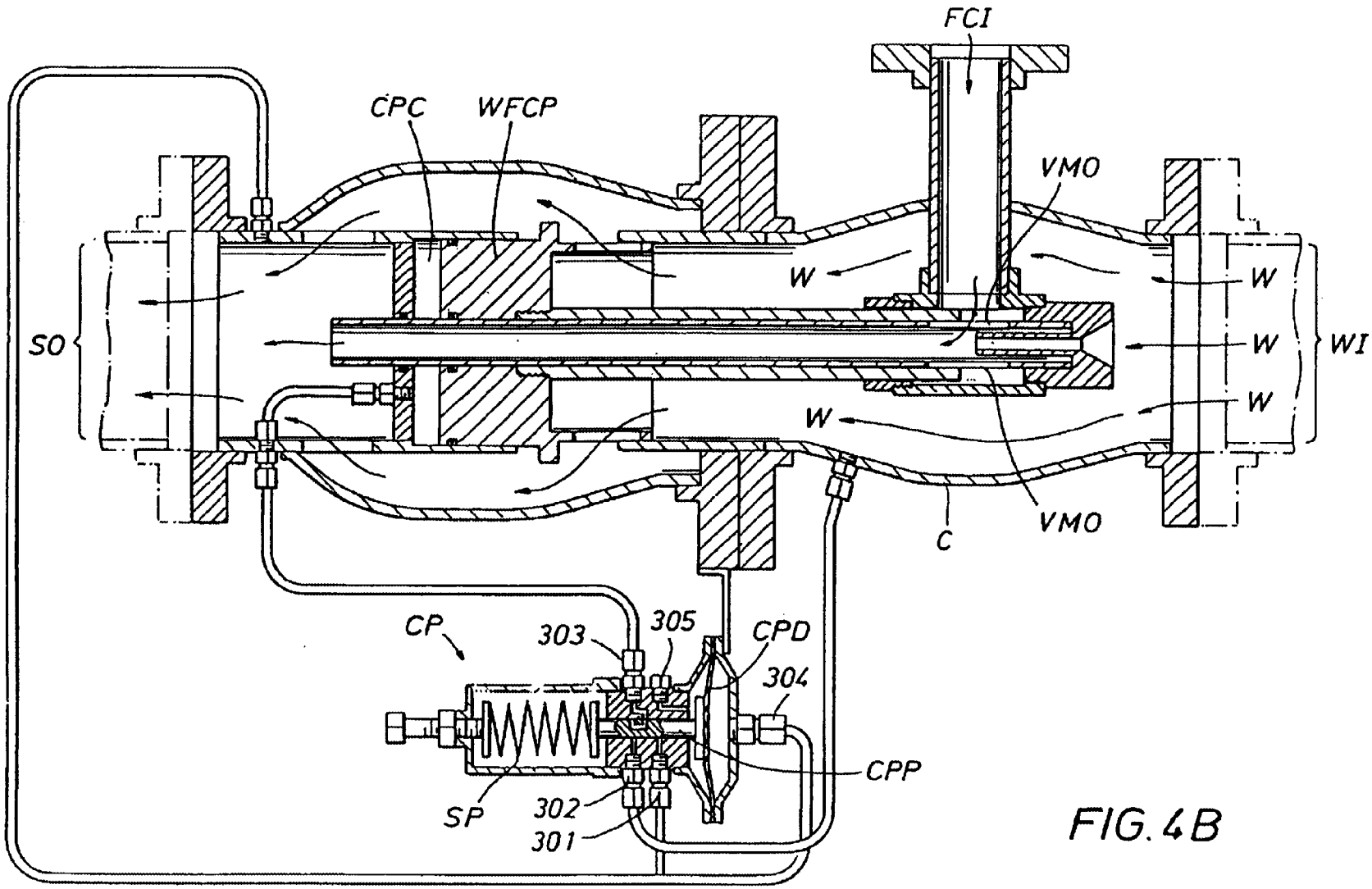

FIG. 4B illustrates the fire fighting fluid conduit, flow regulating valve and venturi of the instant invention with the flow regulating valve open.

Figure 5:
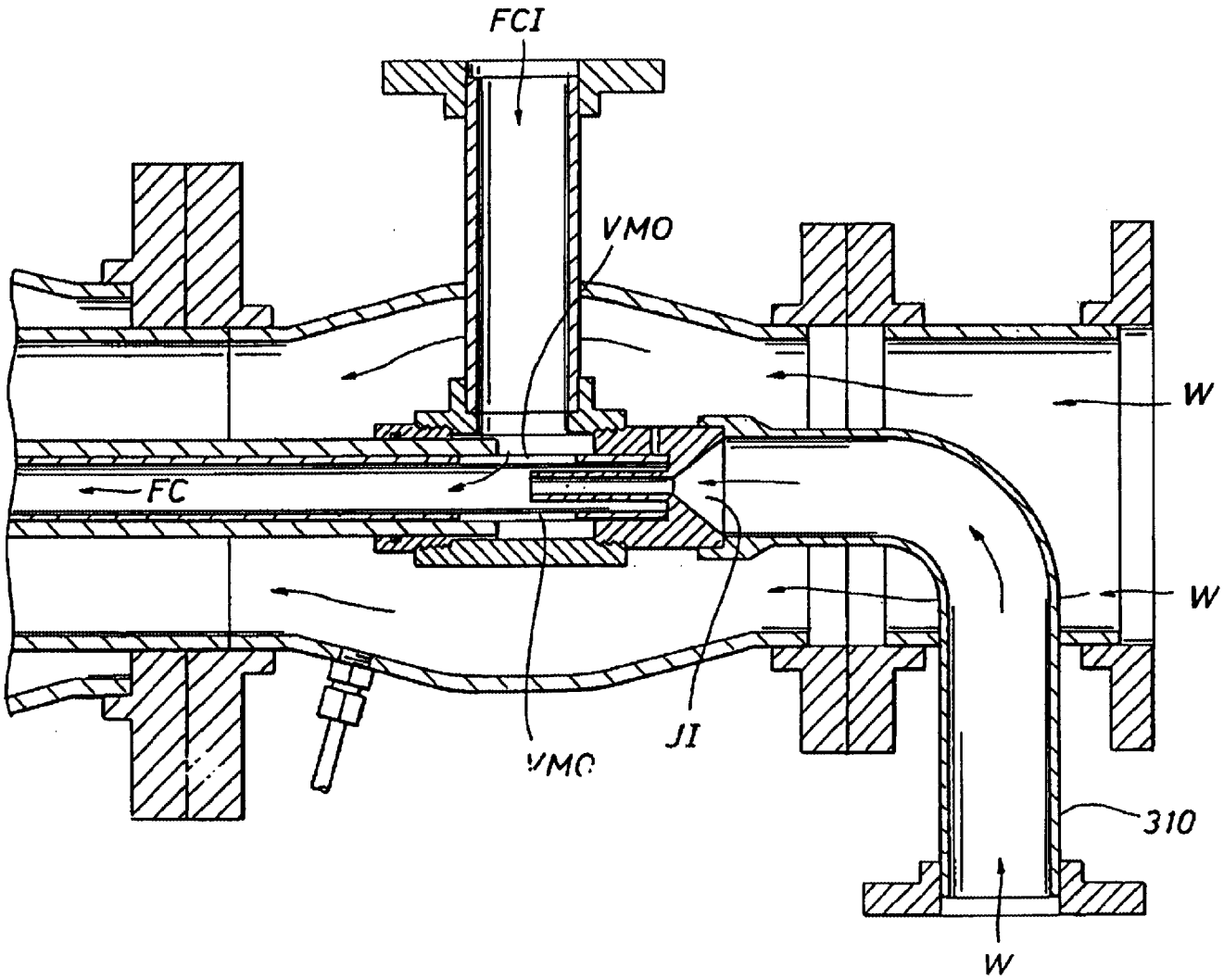
FIG. 5A illustrates a venturi located in a fire fighting fluid conduit, which venturi is supplied with an independent source of motive fluid.

FIG. 5 illustrates that the motive of flow for the venturi could come from an independent source of fluid or water, as opposed to the water in the conduit. FIGS. 4A and 4B illustrated the motive flow for the venturi coming from the water flowing through the water inlet WI of the conduit C. The system could be designed so that the foam concentrate supplied through the foam concentrate inlet FCI could be drawn in by the venturi or pumped in. That is, the source of the foam concentrate could be at atmospheric pressure or could greater than atmospheric pressure.

Figure 6A:
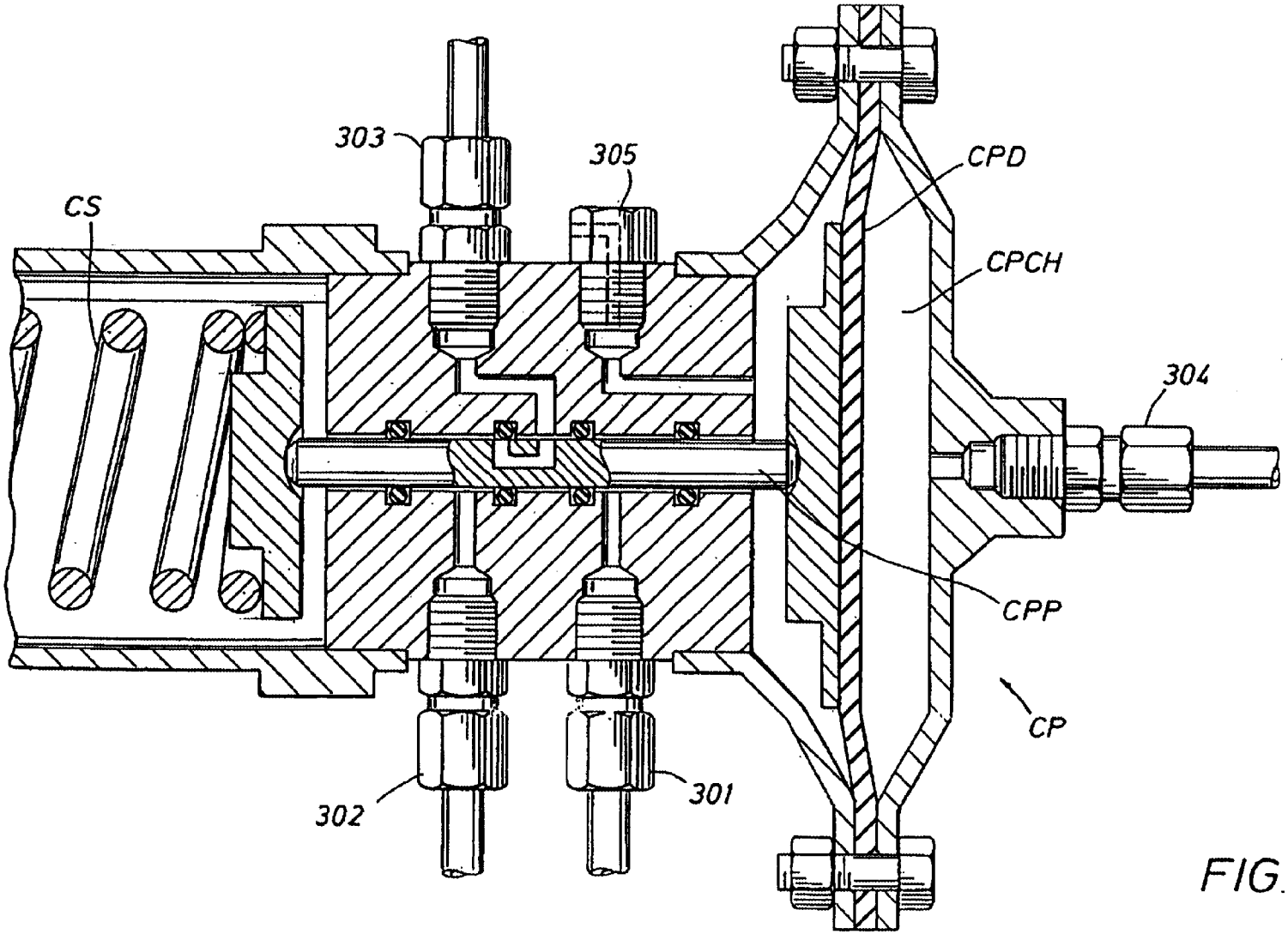
FIGS. 6A, 6B, and 6C illustrate in detail settings of the pilot valve of FIGS. 4A and 4B.
Figure 6B:
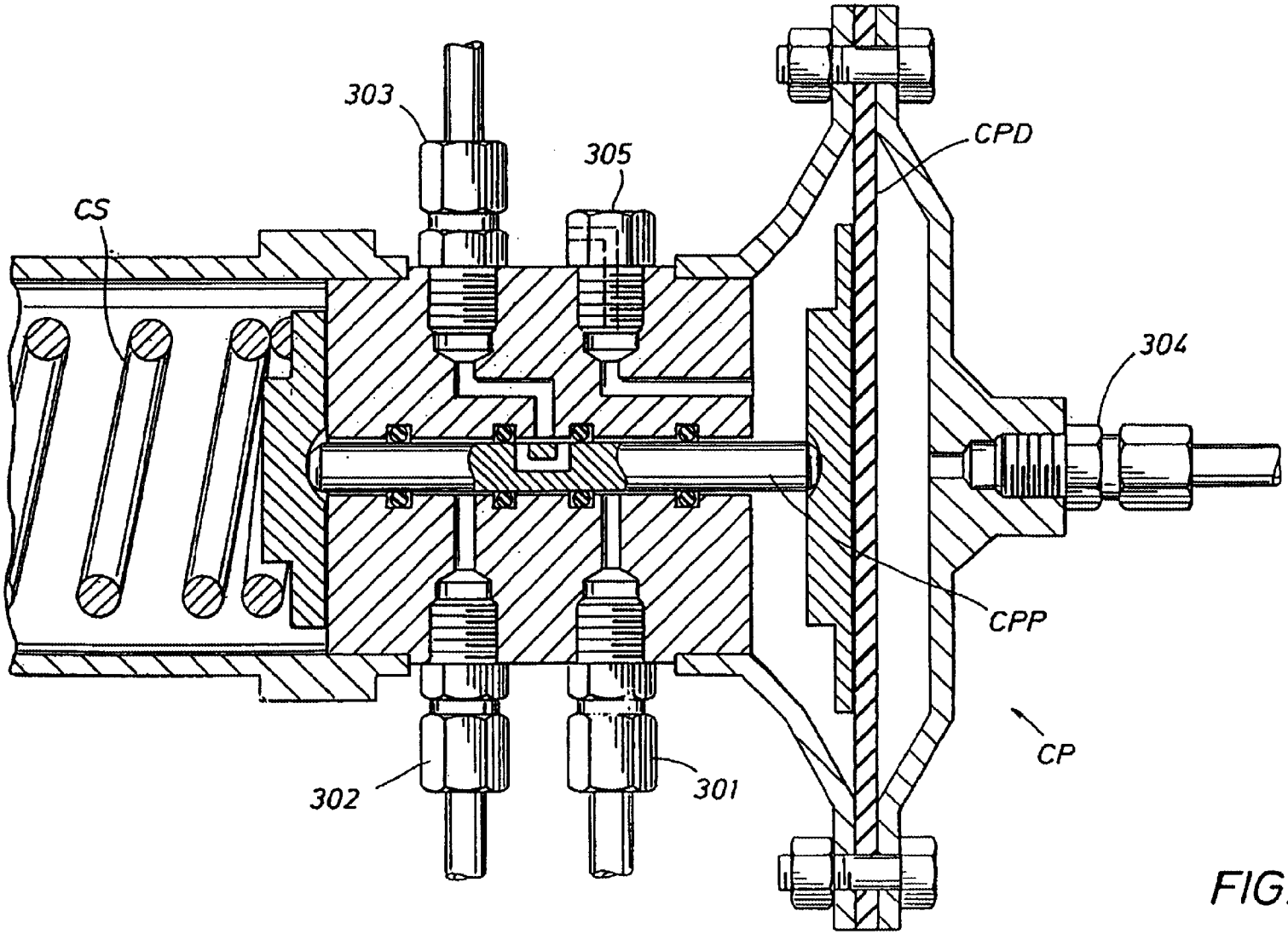
Figure 6C:
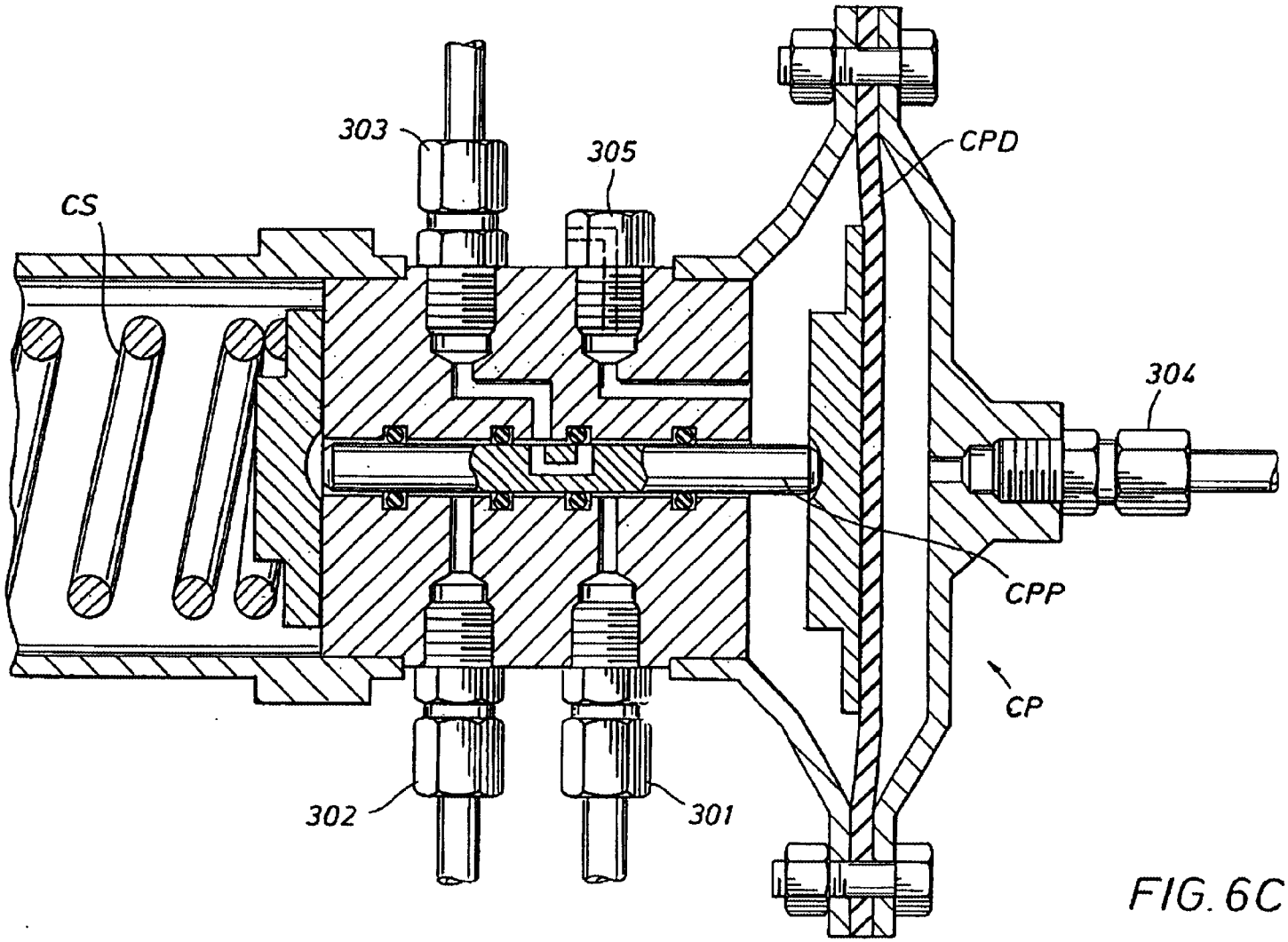

FIGS. 6A, 6B, and 6C illustrate three settings of pilot valve CP. In the first setting, illustrated in FIG. 6A, pilot valve diaphragm CPD is moved against biasing spring CS to its left position. Fluid in pilot CP chamber CPCH, ported in from downstream of the foam concentrate tube discharge through port 304 into chamber CPCH, is greater than and overcomes the pressure of biasing spring CS in the pilot valve. When the downstream pressure of the water exceeds the biasing pressure of the spring, diaphragm CPD moves to its left most position. Control piston chamber CPC of the water flow control piston WFCP is placed in fluid communication, through ports 303 and 302 of pilot valve CP, with water pressure upstream of water flow control piston WFCP. Balancing water pressure on the forward and reverse sides of the water flow control piston WFCP, that is sides PFA and PRA, causes water flow control piston to move to the right and tend to close. Water flow control piston is designed with greater pressure area on the downstream chamber side, side PRA, than on the upstream side, side PFA. As the piston closes water flow declines and pressure downstream of the foam concentrate tube FCIT discharge decreases. When pressure through port 304 suitably decreases, such that it is overcome by a biasing pressure on pilot valve CPP by control spring SP, then control piston diaphragm CPD moves back to its central or neutral position, as illustrated in FIG. 6B. When diaphragm CPD is in its neutral position, fluid through port 303 is blocked and fluid communication through port 303 and the pilot valve is locked. Thus, fluid can neither enter nor leave water flow control piston chamber CPC.

As illustrated in FIG. 6C when water flow pressure downstream of the discharge end of foam concentrate tube FCIT decreases below the biasing value of pilot valve piston spring SP, then diaphragm CPD moves to its right position, as illustrated in FIG. 6C. In its rightmost position, movement of pilot valve piston CPP places water flow control piston chamber CPC in fluid communication through ports 303 and 301 with water pressure in conduit C downstream of the discharge end of the foam concentrate tube FCIT. Such downstream pressure being lower than the upstream pressure on the forward pressure face PFA of the water flow control piston, the water flow control piston tends to move to the left to open up and allow more flow of water through conduit C. With more flow of water through conduit C downstream pressure rises. With rising of downstream pressure control piston diaphragm CPD in the pilot valve CP will tend to move from its rightmost position back to its neutral position as shown in FIG. 6B.

The foregoing disclosure and description of the invention are illustrative and explanatory thereof, and various changes in the size, shape, materials, as well as in the details of the illustrated system may be made without departing from the spirit of the invention. The invention is claimed using terminology that depends upon a historic presumption that recitation of a single element covers one or more, and recitation of two elements covers two or more, and the like.

What is claimed is:

1. A fire fighting foam proportioning system, comprising:

a fire fighting fluid conduit having a fire fighting fluid regulating valve and a foam concentrate discharge;

the concentrate discharge in fluid communication with a valved source of fire fighting foam concentrate;

a pilot valve connected to the regulating valve and the concentrate source valve and adapted to adjust the regulating valve and the source valve in response to a sensed indicia of fire fighting fluid pressure in the conduit; and wherein adjusting the regulating valve includes adjusting fire fighting fluid flow through the valve by opening or closing regulating valve structure.

2. A fire fighting foam proportioning system, comprising:

a fire fighting fluid conduit having a fire fighting fluid regulating valve and a foam concentrate discharge;

the concentrate discharge in fluid communication with a valved source of fire fighting foam concentrate;

a pilot valve connected to the regulating valve and the concentrate source valve and adapted to adjust the regulating valve and the source valve in response to a sensed indicia of fire fighting fluid pressure in the conduit; and wherein the sensed indicia includes fire fighting fluid pressure downstream of the regulating valve.

3. The system of claims 1 or 2 wherein the regulating valve and the source valve are adapted to adjust in tandem.

4. The system of claims 1 or 2 wherein the pilot valve is adapted to maintain a constant fire fighting fluid pressure drop proximate the regulating valve.

5. The system of claims 1 or 2 wherein the conduit is in fluid communication with an educting venturi and a power fluid source of the venturi is directly connected to the fire fighting fluid conduit.

6. The system of claims 1 or 2 wherein the conduit is in fluid communication with an educting verturi and a power fluid source of the venturi is connected to an independent source of fire fighting fluid.

7. The system of claims 1 or 2 wherein the regulating valve is remote from a fire fighting fluid discharge orifice.

8. The system of claims 1 or 2 where the pilot valve is exterior to the fire fighting fluid conduit.

9. A method for proportioning fire fighting foam concentrate, comprising:

discharging fire fighting foam concentrate into a fire fighting fluid conduit proximate a fire fighting fluid regulating valve;

regulating fire fighting fluid flow in the conduit with the valve in accordance with a sensed indicia of fire fighting fluid pressure;

automatically metering foam concentrate into the conduit in accordance with regulated fire fighting fluid flow in the conduit; and wherein regulating fire fighting fluid flow in the conduit with the valve includes adjusting a valve opening in the conduit through which the fire fighting fluid flows.

10. The method of claim 9 wherein the discharging includes by educting powered at least in part by an educting force of fire fighting fluid flowing in the conduit.

11. The method of claim 9 wherein the discharging includes by educting powered at least in part by an educting force of an at least partially independent source of fire fighting fluid.

12. The method of claim 9 wherein the regulating includes maintaining a pre-selected pressure drop in the conduit proximate the discharge.

13. A method for proportioning fire fighting foam concentrate, comprising:

discharging fire fighting foam concentrate into a fire fighting fluid conduit proximate a fire fighting fluid valve;

regulating fire fighting fluid flow in the conduit with the valve in accordance with a sensed indicia of fire fighting fluid pressure;

automatically metering foam concentrate into the conduit in accordance with regulated fire fighting fluid flow in the conduit; and wherein the sensed indicia of fire fighting fluid pressure includes sensed indicia downstream of the discharge.

14. The method of claim 13 wherein the discharging is powered at least in part by an educting force of fire fighting fluid flowing in the conduit.

15. The method of claim 13 wherein the discharging is powered at least in part by an educting force of an at least partially independent source of fire fighting fluid.

16. The method of claim 13 wherein the regulating includes maintaining a pre-selected pressure drop in the conduit proximate the discharge.

* * * * *